United States Patent [19]

Stain et al.

[11] Patent Number: 4,970,730

[45] Date of Patent: Nov. 20, 1990

[54] TOILET SEAT REPAIR ORGANIZATION

[76] Inventors: Emma R. Stain; William T. Stain, both of 1008 W. Auburn Dr., Mobile, Ala. 33618

[21] Appl. No.: 390,979

[22] Filed: Aug. 7, 1989

[51] Int. Cl.[5] ..... E03D 9/00; A47K 13/04

[52] U.S. Cl. ..... 4/222; 4/237; 4/248

[58] Field of Search ..... 4/222, 229, 230, 233, 4/234, 235, 237, 239, 248

[56] References Cited

U.S. PATENT DOCUMENTS

| | | | |
|---|---|---|---|
| 1,051,631 | 1/1913 | Pickles | 4/233 |
| 2,016,412 | 10/1935 | Winding | 4/234 |
| 2,114,551 | 4/1938 | Winding | 4/237 |
| 2,751,604 | 6/1956 | Young | 4/237 |
| 3,593,349 | 7/1971 | Bungo | 4/237 |
| 4,193,144 | 3/1980 | McNally | 4/229 |

FOREIGN PATENT DOCUMENTS

| | | | |
|---|---|---|---|
| 654327 | 12/1962 | Canada | 4/237 |
| 83870 | 7/1935 | Sweden | 4/233 |
| 24117 | of 1893 | United Kingdom | 4/237 |
| 287680 | 3/1928 | United Kingdom | 4/237 |

*Primary Examiner*—Henry J. Recla
*Assistant Examiner*—Robert M. Fetsuga
*Attorney, Agent, or Firm*—Leon Gilden

[57] ABSTRACT

A toilet seat repair organization is set forth wherein a plurality of arcuate segments are formed in a mirror image relative to one another with a planar top and a planar bottom surface parallel to one another with a thickness substantially equal to that of bumper pads of an associated toilet seat. A modification of the instant invention includes a cavity formed with each upper surface to accept a deodorizing container therewithin to enable the deodorizing liquid contained therewithin to be dispersed through the porous repair segments. A further modification utilizes a plurality of arcuate ribs depending downwardly from the repair segments for overlying the upper rim surface of an associated commode to stabilize the toilet seat so repaired relative to the commode.

1 Claim, 4 Drawing Sheets

TOILET SEAT REPAIR ORGANIZATION

BACKGROUND OF THE INVENTION

1. Field of the Invention

The field of invention relates to toilet seat repair devices, and more particularly pertains to a new and improved toilet seat repair organization wherein the same includes a plurality of arcuate segments adherably securable relative to a bottom surface of a toilet seat to be repaired.

2. Description of the Prior Art

The use of toilet seat organizations of various types for a variety of purposes has been developed in the prior art. The prior art, however, has failed to properly address the problem of a means to economically and readily provide apparatus enabling repair of cracked toilet seats and the like. Examples of the prior art include U.S. Pat. No. 2,751,604 to Young utilizing a cushion member secured in surrounding and circling relationship relative to a bottom surface of a toilet seat lid for a silencing effect of the lid when returned to a horizontal overlying relationship relative to an associated commode.

U.S. Pat. No. 3,566,421 to Waddle sets forth the use of an attaching toilet seat guard positioned to a forward end of a toilet seat for use as a shield in combination with a toilet seat.

U.S. Pat. No. 3,593,349 to Bungo provides for the use of an acoustical liner adherably secured to a bottom surface of a toilet seat for silencing the toilet seat in use with a commode.

U.S. Pat. No. 3,772,111 to Ginsburg sets forth a method of constructing a toilet seat formed of a foam-like material formed into an annulus mounted with hinges and bumpers to enable securement to an associated commode.

U.S. Pat. No. 4,451,940 to Grunz utilizes a toilet seat and lid formed with magnetic elements mounted therewithin to prevent the seat from unwarranted descent during a toilet bowl cleaning procedure.

As such, it may be appreciated that there is a continuing need for a new and improved toilet seat repair organization which addresses both the problems of ease of use and effectiveness in construction, and in this respect, the present invention substantially fulfills this need.

SUMMARY OF THE INVENTION

In view of the foregoing disadvantages inherent in the known types of toilet seat repair apparatus now present in the prior art, the present invention provides a toilet seat repair organization wherein the same utilizes a plurality of arcuate segments adherably mounted to a bottom of a broken toilet seat for repair and prolonged use of the seat. As such, the general purpose of the present invention, which will be described subsequently in greater detail, is to provide a new and improved toilet seat repair organizations which has all the advantages of the prior art toilet seat repair devices and none of the disadvantages.

To attain this, the present invention includes a plurality of arcuate segments formed of a thickness substantially equal to that of bumper pads associated with a toilet seat, and wherein the segments are of an arcuate configuration complementary to that of a bottom surface of a typical ellipsoidal toilet seat. A modification of the instant invention includes a cavity formed within the upper surface of each of the segments for deposit of a deodorizing liquid container formed therewithin that is absorbed by the toilet seat segments formed of a permeable or fibrous material. A further modification includes the segments formed with downwardly depending flanges for overlying engagement with upper surfaces of an associated commode to stabilize the seat relative to the commode during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet seat repair organization which has all the advantages of the prior art toilet seat repair devices and none of the disadvantages.

It is another object of the present invention to provide a new and improved toilet seat repair organization which may be easily and efficiently manufactured and marketed.

It is a further object of the present invention to provide a new and improved toilet seat repair organization which is of a durable and reliable construction.

An even further object of the present invention is to provide a new and improved toilet seat repair organization which is susceptible of a low cost of manufacture with regard to both materials and labor, and which accordingly is then susceptible of low prices of sale to the consuming public, thereby making such toilet seat repair organizations economically available to the buying public.

Still yet another object of the present invention is to provide a new and improved toilet seat repair organization which provides in the apparatuses and methods of the prior art some of the advantages thereof, while simultaneously overcoming some of the disadvantages normally associated therewith.

Still another object of the present invention is to provide a new and improved toilet seat repair organization wherein a plurality of arcuate segments are adherably mounted to an underlying surface of a toilet seat for prolonged and extended use of the seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
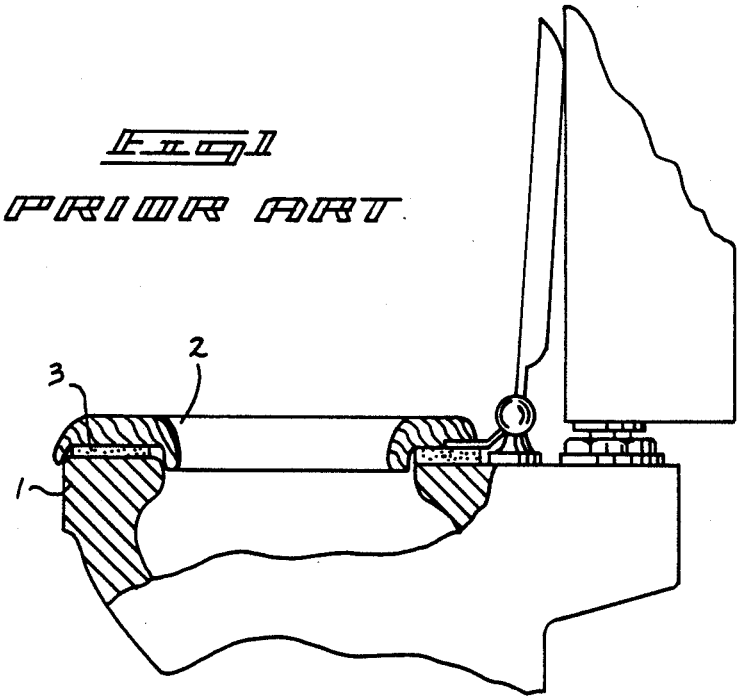
Fig 1 PRIOR ART
FIG. 1 is an orthographic view, partially in section, of a prior art toilet seat and commode lid organization.

With reference now to the drawings, and in particular to FIGS. 1 to 8 thereof, a new and improved toilet seat repair organization embodying the principles and concepts of the present invention and generally designated by the reference numeral 10 will be described.

Figure 2:
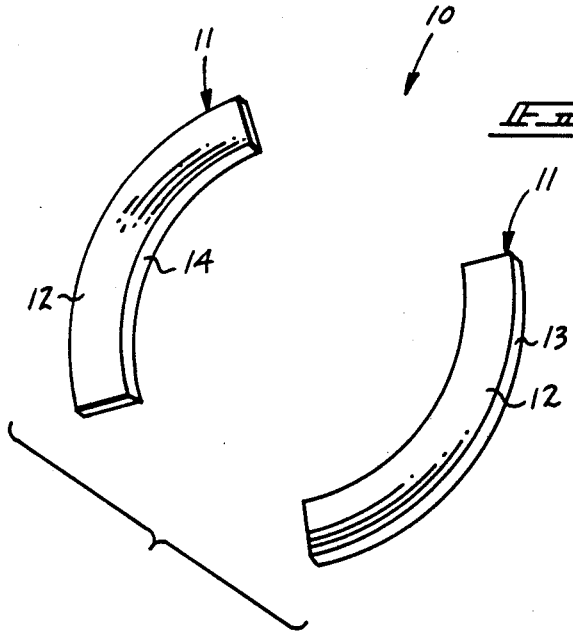
FIG. 2 is an isometric illustration of the arcuate repair segments utilized by the instant invention.

More specifically, the toilet seat repair organization 10 essentially comprises a pair of arcuate repair segments 11, as illustrated in FIG. 2, each formed with a top planar surface 12 in parallel overlying arrangement relative to a bottom planar surface coextensively arranged relative to the top planar surface. The bottom planar surface 15 and the top planar surface 12 are spaced apart a thickness substantially equal to that of bumper pads 16 adherably secured to a bottom surface of a conventional ellipsoidal toilet seat 2. Each of the segments 11 is formed with an exterior convex planar arcuate side surface 13 and an interior concave planar side surface 14 to define the segments of a complementary configuration to that of a typical ellipsoidal toilet seat 2.

FIG. 1 illustrates the use of the bottom bumper surface, or acoustical liner 3, secured to a bottom planar surface of the toilet seat 2 that is of conventional configuration and pivotally mounted at its rearward portion to a commode 1.

Figure 3:
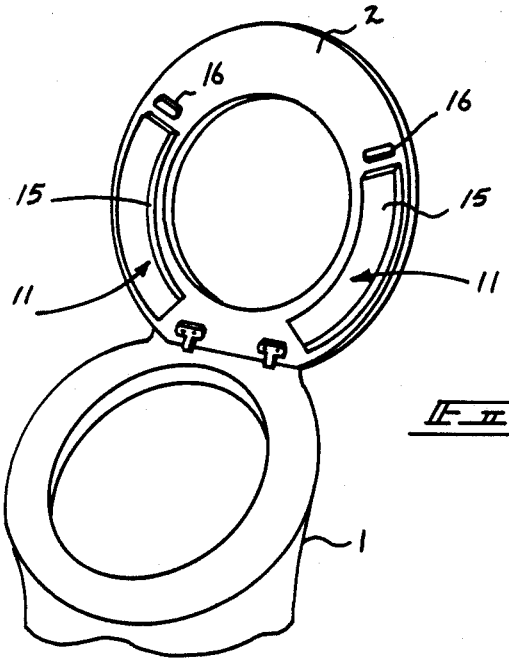
FIG. 3 is an isometric illustration of the arcuate repair segments secured in combination with a toilet seat lid.
Figure 4:
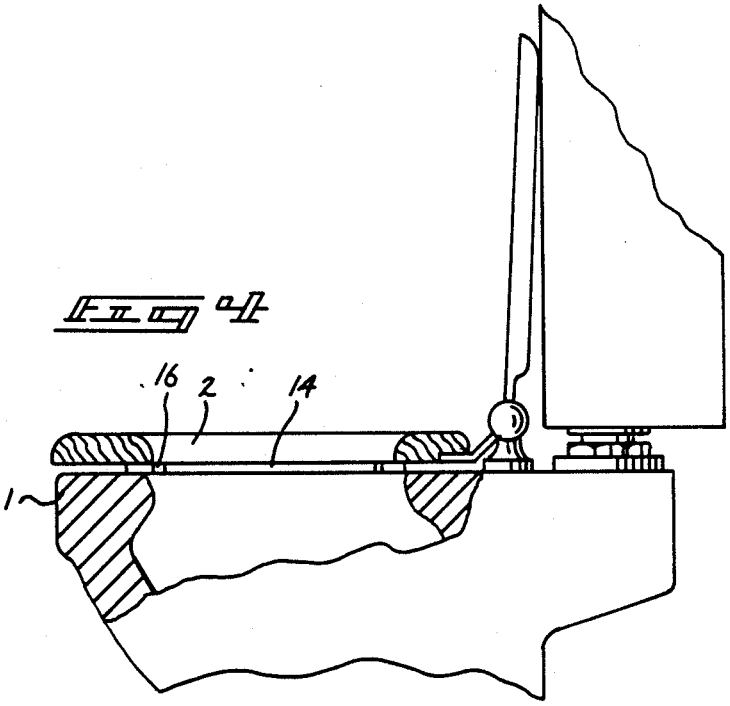
FIG. 4 is an orthographic view, partially in section, of the instant invention secured to a toilet seat lid.

In use, the repair segments 11 are adherably secured to the bottom surface of the toilet seat 2 between the bumper pads 16 and the hinges of the toilet seat to effect repair of the toilet seat 2, as toilet seats will typically break and crack in this region defined between the bumper pads 16 and the hinges, as illustrated in FIG. 3.

Figure 5:
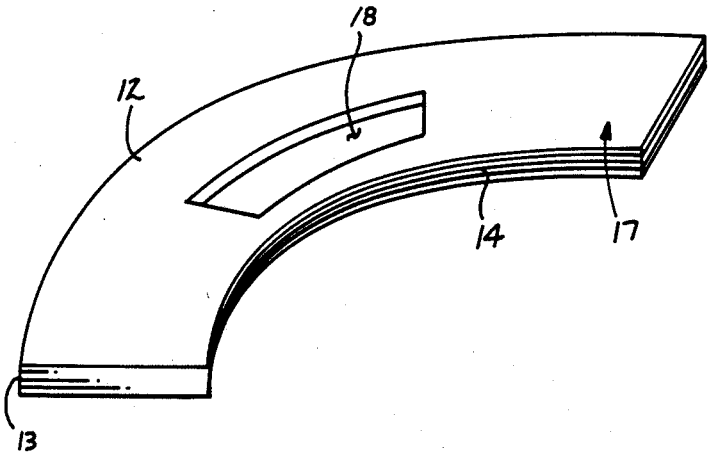
FIG. 5 is an isometric illustration of one of a pair of modified repair segments.
Figure 6:
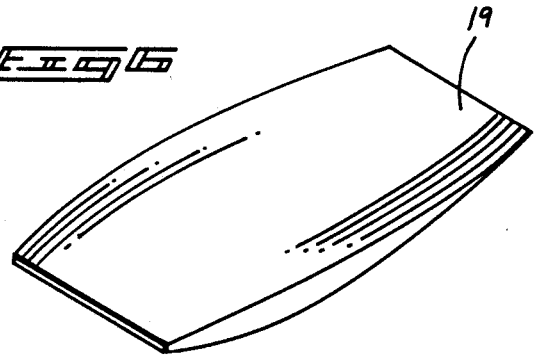
FIG. 6 is an isometric illustration of a liquid deodorizing container utilized by the instant invention.

FIG. 5 is illustrative of a modified arcuate repair segment 17 of a plurality of such segments formed with the aforenoted top planar surface 12 and interior concave side surface 14 and exterior convex side surface 13. The modified repair segment 17 is formed of a porous or fibrous material and is provided with a recess cavity 18 directed through the top surface of the repair segments and spaced below the bottom surface 15 of the repair segment to create a floor within the cavity 18. The cavity 18 is provided for reception of a liquid deodorizer container 19 formed of a complementary volumetric capacity substantially equal to that of the cavity 18 and is encapsulating a liquid detergent that upon puncturing of the container 19, the liquid detergent will disperse and be absorbed within the porous repair segment 17 of the plurality of such repair segments, as will be utilized in a conventional manner as illustrated in FIG. 3.

Figure 7:
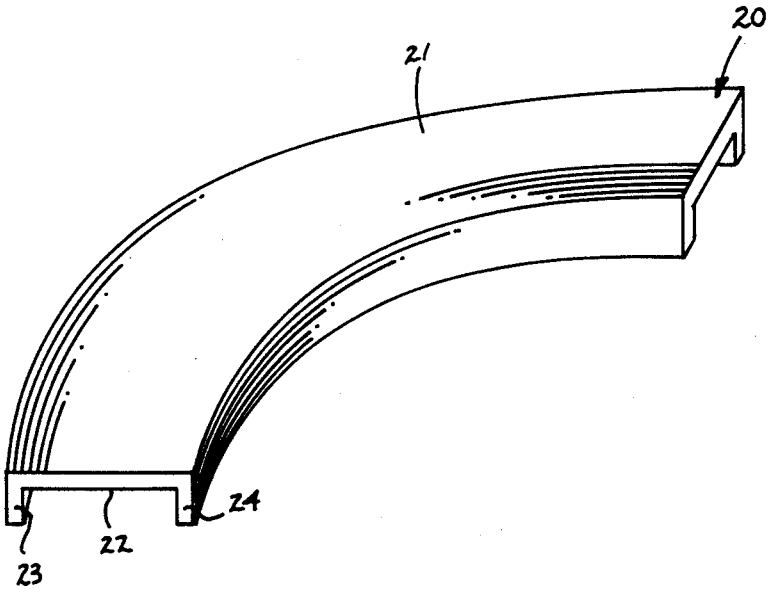
FIG. 7 is an isometric illustration of one of a plurality of repair segments defining a further modification of the instant invention.
Figure 8:
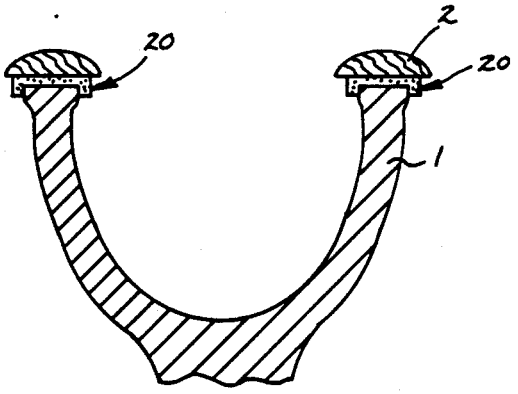
FIG. 8 is an orthographic cross-sectional view of the repair segments of FIG. 7 in combination with a toilet seat lid.

FIG. 7 is illustrative of a further modification of the instant invention wherein the further modified repair segment 20 of such a plurality of repair segments is formed with a top planar surface 21 overlying and parallel to a bottom planar surface 22, but wherein the planar surfaces are formed with an external downwardly extending rib 23 parallel to an internal downwardly extending rib 24. The ribs 23 and 24 are orthogonally formed relative to the top and bottom planar surface 21 and 22 and are of a width substantially equal to that defined by an upper rim of the commode 1, whereupon downward positioning of the toilet seat 2, the repair segments 20 will receive the top surface of the commode 1 and prevent movement of the seat 2 relative to the commode 1 minimizing strain on the associated hinges and stress on the commode seat to itself.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seat repair organization in combination with an ellipsoidal toilet seat and a commode, the toilet seat formed with a planar bottom seat surface and including spaced bumper pads secured to said bottom surface on opposite sides of a major axis defining the toilet seat, wherein the bumper pads are of predetermined thickness, and a hinge secured at a rear bottom surface of the toilet seat pivotally mounting the toilet seat to a rear portion of an upper surface of a commode, the repair organization comprising, a plurality of separate arcuate segments, each segment secured to the bottom surface of the toilet seat between the hinge and a bumper pad, and wherein each segment is formed with a planar top segment surface coextensively aligned with and parallel to a bottom planar segment surface, and wherein each segment is further defined by an interior concave side wall and an exterior convex side wall, and wherein each of the toilet seat segments are of a thickness equal to the predetermined thickness, and wherein each of the toilet seat segments is of an arcuate configuration complementary to that defined by the toilet seat, and wherein each of the segments includes an enclosed cavity formed in and surrounded by the top segment surface of each of the segments and further including a puncturable liquid deodorant container receivable within each of the cavities, and the top segment surface of each of the segments in confronting contiguous association with the bottom surface of the toilet seat, and wherein each of the segments is formed of a porous liquid absorbent material for absorption of a liquid contained within the liquid container.

* * * * *